US006767498B1

(12) United States Patent
Talley, Jr. et al.

(10) Patent No.: US 6,767,498 B1
(45) Date of Patent: Jul. 27, 2004

(54) PROCESS OF MAKING MICROFILAMENTS

(75) Inventors: Arthur Talley, Jr., Melbourne, FL (US); Frank O. Harris, Rogersville, TN (US); Jeffrey S. Dugan, Erwin, TN (US); Arnold E. Wilkie, Merritt Island, FL (US); Jing-Peir Yu, deceased, late of Pensacola, FL (US), by Shiang-Jung Ma Yu, legal representative

(73) Assignees: Hills, Inc., West Melbourne, FL (US); Fiber Innovation Technology, Inc., Johnson City, TN (US)

( * ) Notice: Subject to any disclaimer, the term of this patent is extended or adjusted under 35 U.S.C. 154(b) by 0 days.

(21) Appl. No.: 09/821,456

(22) PCT Filed: Oct. 6, 1999

(86) PCT No.: PCT/US99/23267

§ 371 (c)(1),
(2), (4) Date: Oct. 9, 2001

(87) PCT Pub. No.: WO00/20178

PCT Pub. Date: Apr. 13, 2000

Related U.S. Application Data

(63) Continuation-in-part of application No. 09/404,245, filed on Sep. 22, 1999.

(60) Provisional application No. 60/103,300, filed on Oct. 6, 1998.

(51) Int. Cl.[7] ..... D01D 5/16; D01D 10/02; D02G 1/20; D02G 3/22; H05B 6/64

(52) U.S. Cl. ..... 264/474; 28/271; 57/287; 264/103; 264/147; 264/171.1; 264/210.2; 264/210.5; 264/210.8

(58) Field of Search ..... 264/103, 147, 264/171.1, 210.2, 210.5, 210.8, 474; 28/271; 57/287

(56) References Cited

U.S. PATENT DOCUMENTS 3,485,759 A 12/1969 Evans
3,972,759 A 8/1976 Buntin
4,239,720 A 12/1980 Gerlach et al.
4,364,983 A 12/1982 Brücher et al.
4,622,259 A 11/1986 McAmish et al.
4,663,221 A 5/1987 Makimura et al.
4,789,592 A 12/1988 Taniguchi et al.
4,988,560 A 1/1991 Meyer et al.
5,057,368 A 10/1991 Largman et al.
5,069,970 A 12/1991 Largman et al.
5,093,061 A 3/1992 Bromley et al.
5,108,820 A 4/1992 Kaneko et al.
5,162,074 A 11/1992 Hills
5,277,976 A 1/1994 Hogle et al.
5,336,552 A 8/1994 Strack et al.
5,382,400 A 1/1995 Pike et al.
5,586,997 A 12/1996 Pall et al.
5,656,368 A 8/1997 Braun et al.
5,707,735 A 1/1998 Midkiff et al.
5,759,926 A 6/1998 Pike et al.
5,783,503 A 7/1998 Gillespie et al.
5,785,725 A 7/1998 Cusick et al.
2003/0166370 A1 * 9/2003 Harris et al. ..... 442/356

OTHER PUBLICATIONS

John Hagewood, Ultra Microfibers: Beyond Evolution; pp. 47–48, IFJ, Oct. 1998.

* cited by examiner

*Primary Examiner*—Leo B. Tentoni
(74) *Attorney, Agent, or Firm*—Edell, Shapiro & Finnan, LLC

(57) ABSTRACT

Thermally divisible multicomponent fibers (4) having at least a first component including an elastomeric polymer (6) and at least a second component including a non-elastomeric polymer (8). The multicomponent fibers are useful in the manufacture of nonwoven structures, and in particular non-woven structures used as synthetic suede and filtration media.

20 Claims, 3 Drawing Sheets

PROCESS OF MAKING MICROFILAMENTS

CROSS REFERENCE TO RELATED APPLICATIONS

This application is a national phase application of PCT International Application No. PCT/US99/23267, filed Oct. 6, 1999, and is a continuation-in-part of U.S. patent application Ser. No. 09/404,245, entitled "A Splittable Multicomponent Elastomeric Fibers," filed Sept. 22, 1999, the disclosure of which is incorporated herein by reference in its entirety. This application also claims priority from U.S. Provisional Patent Application Serial No. 60/103,300, entitled "Spun-Like Elastic Filament Yarns," filed Oct. 6, 1998, the disclosure of which is incorporated herein by reference in its entirety.

BACKGROUND OF THE INVENTION

1. Field of the Invention

The present invention is related to fine denier fibers. In particular, the invention is related to fine denier fibers obtained by splitting multicomponent fibers having an elastomeric component and to fabrics made from such fibers.

2. Description of the Related Art

Fibers formed of synthetic polymers have long been recognized as useful in the production of textile articles. Such fibers can be used in diverse applications such as apparel, disposable personal care products, medical garments, filtration media, and carpet.

It can be desirable to incorporate fine or ultrafine denier fibers into a textile structure, such as filtration media. Fine denier fibers may be used to produce fabrics having smaller pore sizes, thus allowing smaller particulates to be filtered from a fluid stream. In addition, fine denier fibers can provide a greater surface area per unit weight of fiber, which can be beneficial in filtration applications. Fine denier fibers can also impart u soft feel and touch to fabrics.

Fine denier fibers are also advantageous in producing synthetic yarns and fabrics. Yarns and fabrics made from synthetic fibers aim to be competitive with yarns and fabrics made from natural fibers by simulating spun yarns, and a variety of techniques have been attempted to produce synthetic materials having improved characteristics such as greater bulkiness and softness, superior flexibility and drape, and better barrier and filtration properties.

One method of simulating spun yarns involves cutting continuous synthetic filaments into staple fibers and spinning the staple fibers into yarns by conventional spinning methods used for natural fibers. However, this approach is a time consuming and costly. Alternatively, continuous filaments can be converted into yarns by various texturing methods at lower cost, but these yarns often inadequately simulate spun yarns.

Another technique for converting filament yarns into simulated spun yarns is the air-jet texturing process. In this process, a cold air stream is used to produce loopy bulked yarns of low extensibility. The yarn surface is covered with fixed resilient loops, which serve the same purpose as the protruding hairs in spun yarns by forming an insulating layer of entrapped still air between neighboring layers or garments (see FIG. 5A). Synthetic yarns produced by the air-jet texturing more closely simulate spun yarn structures and resemble spun fiber yarns in their appearance and physical characteristics, although these air-jet textured yarns are not stretchable. Currently, air-jet textured yarns are widely used in outerwear and lighter-wear fabrics, upholstery fabrics and other textile applications. The use of fine denier fibers results in synthetic yarns and fabrics having desirable properties such as good softness and bulkiness as well as good flexibility and fabric drape, with superior filtration and barrier properties and coverage at low weight.

It is, however, difficult to produce fine denier fibers, in particular fibers of 2 denier or less, using conventional melt extrusion processes. Meltblowing technology is one avenue by which to produce fabric from fine denier filaments. However, meltblown webs typically do not have good physical strength, primarily because less orientation is imparted to the polymer during processing and lower molecular weight resins are employed.

Multicomponent or composite fibers having two or more polymeric components may be split into fine fibers comprised of the respective components. The single composite filament thus becomes a bundle of individual component microfilaments. Typically, multicomponent fibers are divided or split by mechanically working the fibers. Methods commonly employed to work fibers include drawing on godet rolls, beating or carding. Fabric formation processes such as needle punching or hydroentangling may supply sufficient energy to a multi component fiber to effect separation.

In addition, fine denier fibers can be prepared using a multicomponent fiber comprised of a desired polymer and a soluble polymer. The soluble polymer is then dissolved out of the composite fiber, leaving microfilaments of the other remaining insoluble polymer. The use of dissolvable matrixes, however, to produce fine denier filaments is problematic. Manufacturing yields are inherently low because a significant portion of the multiconstituent fiber must be destroyed to produce the microfilaments. The wastewater or spent hydrocarbon solvent generated by such processes poses an environmental issue. In addition, the time required to dissolve the matrix component out of the composite fiber further exacerbates manufacturing inefficiencies.

In addition to fine denier fibers, it can also be desirable to incorporate elastomeric fibers into textile structures to impart stretch and recovery properties. Elastomeric fibers or filaments are typically incorporated into fabrics to allow the fabrics to conform to irregular shapes and to allow more freedom of body movement than fabrics with more limited extensibility.

Elastomers used to fabricate elastic fabrics, however, often have an undesirable rubbery feel. Thus, when these materials are used in fabrics, the hand and texture of the fabric can be perceived by the user as sticky or rubbery and therefore undesirable. Non-elastomeric fibers can be commingled with elastomeric fibers and/or coated with an elastomeric solution to improve the feel of articles formed using elastic fibers. However, this requires additional processing steps, which can add manufacturing and materials costs. For example, a stretchable fabric is commonly produced with filament yarns or spun (staple) yarns in combination with an elastic yarn. One commonly used elastic yarn is a wrapped yarn, which has elastic filament yarn, such as Spandex yarn, in the core and wrapped by a synthetic filament yarn (see FIG. 5B). The synthetic filament wrap yarn provides abrasive protection to the elastic core yarn. The process of making such a wrapped yarn is slow and costly. To acquire both soft and stretchable properties, the conventional yarns need to be processed through many steps of blending and twisting, which are impractical and expensive.

Further, it can be difficult to process elastomeric materials to make elastic fibers or filaments. For example, many elastomeric yarns arc formed of solvent spun elastomeric materials (Spandex). Elastomeric yarns can be produced by thermally extruding elastomeric filaments. However, one problem with this approach is breakage or elastic failure during extrusion and drawing. Due to the stretch characteristics of elastomeric polymers, the filaments tend to snap and break while being attenuated. If a filament breaks during production, the ends of the broken filament can either clog the flow of filaments or enmesh the other filaments, resulting in a mat of tangled filaments.

Elastic webs having fine denier elastomeric fibers can be produced using meltblowing technology. However, as noted above, meltblown webs typically do not have good physical strength. In addition, meltblown elastomeric webs generally have less aesthetic appeal.

SUMMARY OF THE INVENTION

The present invention provides splittable multicomponent fibers and fiber bundles which include a plurality of fine denier filaments having many varied applications in the textile and industrial sector. The fibers can exhibit many advantageous properties, such as a soft, pleasant hand, high covering power, stretch and recovery and the like. The present invention further provides fabrics formed of the multicomponent fibers and fiber bundles, as well as processes by which to produce fine denier filaments.

In particular, the invention provides thermally divisible or splittable fibers formed of elastomeric components and non-elastomeric components. The elastomeric and non-elastomeric components are selected to have sufficient mutual adhesion to allow the formation of a unitary multicomponent fiber. Indeed, the fibers can be mechanically worked, for example, by drawing, carding, cutting, and the like, without splitting, and without additives to prevent splitting upon mechanical action. Yet the adhesion of the components is sufficiently low so as to allow the components to separate or split when thermally treated.

Specifically, the adhesion of die elastomeric and non-elastomeric components to one another can be defined in terms of the difference of solubility parameters of the elastomeric polymer and the non-elastomeric polymer. In this regard, the elastomeric polymer is selected to have a solubility parameter ($\delta$) sufficiently different from the non-elastomeric polymer so that the elastomeric component and the non-elastomeric component split upon thermal activation. Preferably the elastomeric polymer and the non-elastomeric polymer have a difference in solubility parameters ($\delta$) of at least about 1.2 $(J/cm^3)^{1/2}$, and more preferably at least about 2.9 $(J/cm^3)^{1/2}$. In one particularly advantageous aspect of the invention, the divisible multicomponent fiber includes at least one polyurethane component and at least one polyolefin, preferably polypropylene, component.

The fibers can have a variety of configurations, including pie/wedge fibers, segmented round fibers, segmented oval fibers, segmented rectangular fibers, segmented ribbon fibers, and segmented multilobal fibers. Further, the thermally splittable multicomponent fibers can be in the form of continuous filaments, staple fibers, or meltblown fibers.

The polymer components are dissociable by thermal means under conditions of low or substantially no tension (i.e., under relaxation) to form a bundle of fine denier elastomeric fibers and fine denier non-elastomeric fibers. The fiber bundle can have desirable stretch and recovery properties as well as desirable aesthetics. Generally the fibers of the invention can be drawn prior to thermal treatment to plastically deform the non-elastomeric components so that they remain drawn even under no stress. Thus the length of the plastically deformed non-elastomeric components is greater than the length of the non-elastomeric components before drawing. In contrast, the elastomeric components are elastically deformed and remain in their stretched or drawn state only because of the friction thereof with the surfaces of the non-elastic components. It has unexpectedly been found that after drawing, thermally treating the multicomponent fibers under relaxation provides sufficient impetus to release the hold of one polymer component on the other. This release allows the elastomeric components to contract, which splits the components of the fibers. In addition to permitting contraction of the elastomeric components, thermal treatment has also been found to shrink the elastomeric components, thereby enhancing the separation of the components of the fibers.

Additionally, the inventors have also found that release of the adhesion forces between the elastomeric and non-elastomeric components by thermal treatment under conditions of low or substantially no tension causes the non-elastomeric filaments to bulk or bunch up around the elastomeric filaments. In effect, as the elastomeric filaments contract and shrink, the force of this elastomeric contraction and shrinkage shortens the length (i.e., the end-to-end straight line distance) occupied by the bundle so that the non-elastomeric filaments (which are longer than the elastomeric filaments) bunch up. This imparts bulk to the resultant fiber bundle to form a "self bulked" or "self texturized" microfilament yarn with elastic stretch. In addition, the bulked non-elastomeric microfilaments bulk around the exterior of the yarn so that the bulked non-elastomeric microfilaments substantially surround or cover the elastomeric filaments. The resultant fiber bundle is elastomeric yet has a pleasant feel due to the bulked non-elastomeric microfilaments covering the surface of the fiber bundle.

This also imparts the ability to provide differential color to the bulked yarn. The elastomeric components and non-elastomeric components can be melt colored with different colors. The yarn will have a first color in its unstretched condition (imparted primarily by the exterior bulked non-elastomeric filaments), and a different color in its stretched condition (imparted by exposure of the differently colored interior elastomeric filaments and a blend of the color of both the elastomeric and non-elastomeric filaments).

The multicomponent fibers can also be formed into elastomeric yarns, for example, by directing the fibers through a conventional texturizing air jet to commingle the fibers. The multicomponent fibers can be thermally treated first to split the multicomponent fibers to form a fiber bundle, and the fiber bundle can thereafter be directed through a texturizing jet to form a bulked yarn. Alternatively, the multicomponent fibers can be simultaneously split and texturized within an air jet to form a bulked yarn.

The multicomponent fibers can also be formed into a variety of other textile structures, including nonwoven, woven and knit fabrics. In this aspect of the invention, the multicomponent fibers can be divided into microfilaments prior to, during, or following fabric formation. The resultant fabrics also exhibit desirable hand and elastic stretch and recovery.

Products comprising the fabric of the present invention provide further advantageous embodiments. Particularly preferred products include synthetic suede fabrics, filtration media, dental floss and synthetic fabrics useful in disposable absorbent articles.

The splittable multicomponent fibers of the invention are generally made by extruding a plurality of multicomponent fibers having at least one elastomeric polymeric component and at least one non-elastomeric polymeric component. The elastomeric and non-elastomeric polymers have solubility parameters sufficiently different so that the elastomeric and non-elastomeric components split upon thermal activation. The multicomponent fibers are advantageously drawn, and then thermally treated under conditions of low or substantially no tension (i.e., under relaxation) to separate the multicomponent fibers to form a fiber bundle of elastomeric microfilaments and non-elastomeric microfilaments. This is contrary to conventional fiber processing steps which are typically conducted while holding the fibers under tension.

Advantageously the fibers are split by contacting the fibers with a heated gaseous medium, such as heated air. Other types of heat can be used, including radiant or steam heat, although the presence of water is not required to achieve splitting. Other types of heating apparatus can also be used, such as hot plates, heated rolls, hot baths (water or oil), microwave energy and the like.

The process also eliminates the need for solvents to dissolve one component or mechanical working to split the fibers. Further, the fibers can be extruded, drawn, and otherwise mechanically worked without substantial premature splitting during these process steps, thus imparting a greater degree of control in initiating splitting. A combination of thermal treatment and subsequent mechanical working can be used to achieve a very high degree of fiber splitting. In addition, the process allows the extrusion of fibers having elastic stretch and recovery properties without the problems typically associated with extruding elastomeric monocomponent fibers.

Still further, the multicomponent fiber can be structured to minimize the occurrence of the elastomer on surfaces of the fibers that come into contact with processing equipment (such as lobe tips). For example a segmented multilobal fiber having a segmented "cross" configuration can be useful in this regard. This can be advantageous in processes in which the fibers contact metal surfaces, such as carding, by reducing fiber-to-metal friction problems associated with some elastomeric fibers, such as polyurethane fibers.

Further understanding of the processes and systems of the invention will be understood with reference to the brief description of the drawings and detailed description which follows herein.

DESCRIPTION OF THE PREFERRED EMBODIMENTS

The present invention will be described more fully hereinafter in connection with illustrative embodiments of the invention which are given so that the present disclosure will be thorough and complete and will fully convey the scope of the invention to those skilled in the art. However, it is to be understood that this invention may be embodied in many different forms and should not be construed as being limited to the specific embodiments described and illustrated herein. Although specific terms are used in the following description, these terms are merely for purposes of illustration and are not intended to define or limit the scope of the invention. As an additional note, like numbers refer to like elements throughout.

Referring now to FIGS. 1A–1I, cross sectional views of exemplary multicomponent fibers of the present invention are provided. The multicomponent fibers of the invention, designated generally as 4, include at least two structured polymeric components, a first component 6, comprised of an elastomeric polymer, and a second component 8, comprised of a non-elastomeric polymer.

In general, multicomponent fibers are formed of two or more polymeric materials which have been extruded together to provide continuous polymer segments which extend down the length of the fiber. For purposes of illustration only, the present invention will generally be described in terms of a bicomponent fiber. However, it should be understood that the scope of the present invention is meant to include fibers with two or more components. In addition, the term "fiber" as used herein means both fibers of finite length, such as conventional staple fiber, as well as substantially continuous structures, such as filaments, unless otherwise indicated.

Figure 1C:
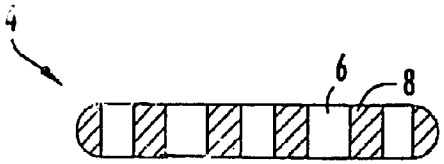
FIGS. 1A–1I are cross sectional views of exemplary embodiments of multicomponent fibers in accordance with the present invention.
Figure 1B:
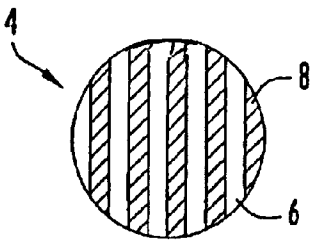
Figure 1A:
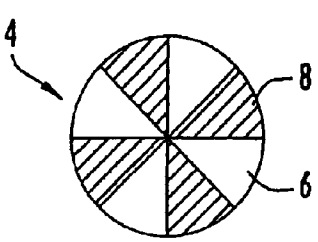
Figure 1G:
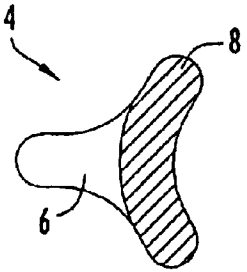
Figure 1F:
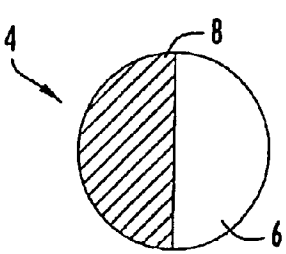
Figure 1E:
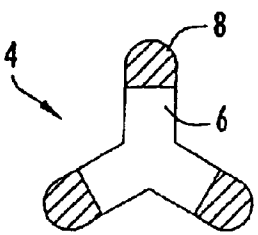
Figure 1D:
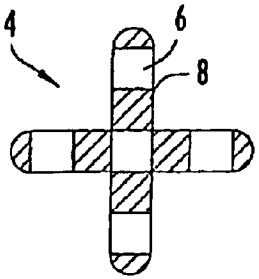
Figure 1I:
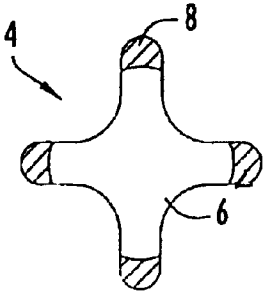
Figure 1H:
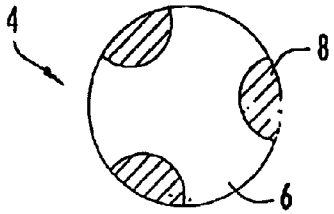

As illustrated in FIGS. 1A–1I, a wide variety of fiber configurations that allow the polymer components to be free to dissociate are acceptable. Typically, the fiber components are arranged so as to form distinct unocclusive cross-sectional segments along the length of the fiber so that none of the components is physically impeded from being separated. One advantageous embodiment of such a configuration is the pie/wedge arrangement, shown in FIG. 1A. The pie/wedge fibers can be hollow or non-hollow fibers. In particular, FIG. 1A provides a bicomponent filament having eight alternating segments of triangular shaped wedges of elastomeric components 6 and non-elastomeric components 8. It should be recognized that more than eight or less than eight segments can be produced in filaments made in accordance with the invention. Other round fiber configurations as known in the art may be used, such as but not limited to: the segmented round configuration shown in FIG. 1B; a simple two-segment side-by-side bicomponent round fiber as shown in FIG. 1F; and a fiber having a round transverse cross section with non-elastomeric component segments 8 (e.g., semi-circular pockets) formed along the periphery of an elastomeric base component 6 as shown in FIG. 1H. For a further discussion of multicomponent fiber constructions, reference is made to U.S. Pat. No. 5,108,820 to Kaneko et al., U.S. Pat. No. 5,336,552 to Strack et al., and U.S. Pat. No. 5,382,400 to Pike et al., the disclosures of which are incorporated herein by reference in their entireties.

Further, the multicomponent fibers need not be conventional round fibers. Other useful shapes include: the segmented oval configuration shown in FIG. 1C; the segmented multilobal fiber configuration shown in FIG. 1D having a cross-shaped cross section; the cross-shaped fiber configuration shown in FIG. 1I having non-elastomeric components 8 at the tip of each lobe; the segmented multilobal fiber configuration of FIG. 1E having a trilobal cross section; and the trilobal fiber configuration shown in FIG. 1G having one elastomeric lobe 6 and two non-elastomeric lobes 8. Such unconventional shapes are further described in U.S. Pat. No. 5,277,976 to Hogle et al., and U.S. Pat. Nos. 5,057,368 and 5,069,970 to Largman et al., the disclosures of which are incorporated herein by reference in their entireties.

Both the shape of the fiber and the configuration of the components therein will depend upon the equipment which is used in the preparation of the fiber, the process conditions and the melt viscosities of the two components. A wide variety of fiber configurations are possible. As will be appreciated by the skilled artisan, typically the fiber configuration is chosen such that one component does not encapsulate, or only partially encapsulates, other components.

Further, to provide dissociable properties to the composite fiber, the polymer components are chosen so as to be mutually incompatible. In particular, the polymer components do not substantially mix together or enter into chemical reactions with each other. Specifically, when spun together to form a composite fiber, the polymer components exhibit a distinct phase boundary between them so that substantially no blend polymers are formed, preventing dissociation. In addition, a balance of adhesion/incompatibility between the components of the composite fiber is considered highly beneficial. The components advantageously adhere sufficiently to each other to allow formation of a unitary unsplit multicomponent fiber, which can be subjected to conventional textile processing such as winding, twisting, weaving, or knitting without any appreciable separation of the components until desired (and specifically in this application until thermal treatment as described in more detail below). Conversely, the polymers should be sufficiently incompatible so that adhesion between the components is sufficiently weak, thereby allowing ready separation upon the application of thermal treatment.

In this regard, in the present invention, the elastomeric and non-elastomeric polymers should be selected so that the polymers exhibit low mutual adhesion to one another as exemplified by the difference in their respective polymer solubility parameters (δ). Desirably the elastomeric and non-elastomeric polymeric components of the multicomponent fibers have a difference in solubility parameters (δ) of at least about 1.2 $(J/cm^3)^{1/2}$ for polymers above a $MW_g$ of 20,000, and preferably greater than about 2.9 $(J/cm^3)^{1/2}$.

Tables of solubility parameter values for many solvents and some polymers, as well as methods for estimating solubility parameter values for polymers and copolymers, can be found in "Polymer Handbook," 2nd Edition, J. Brandrup and E. H. Immergut, Editors, Wiley-Interscience, New York, 1975, p. IV-337ff, which is incorporated by reference herein. See also Fred Billmeyer, Jr. "Textbook of Polymer Science", 3rd Ed.; K. L. Hoy, "New Values of the Solubility Parameters from Vapor Pressure Data," J. Paint Technology, 42, p. 76–118 (1970), incorporated herein by reference in its entirety. The use of solubility parameters in determining the compatibility of polymers has been described, for example, by C. B. Bucknall in "Toughened Plastics", chapter 2, Applied Science Publishers Ltd., London, 1977, incorporated herein by reference in its entirety.

Examples of elastomeric polymers which may be useful in the present invention include without limitation thermoplastic grade polyurethane elastomers, ethylene-polybutylene copolymers, poly(ethylene-butylene) polystyrene block copolymers, such as those sold under the trade name Kraton by Shell Chemical Company, polyadipate esters, such as those sold under the trade name Pellethane by Dow Chemical Company, polyester elastomeric polymers, polyamide elastomeric polymers, polyetherester elastomeric polymers, such as those sold under the trade name Hydrel by DuPont Company, ABA triblock or radial block copolymers, such as styrene-butadiene-styrene block copolymers sold under the trade name Kraton by Shell Chemical Company, as well as blends of thereof.

Suitable non-elastomeric polymers include without limitation polyolefins, polyesters, polyamides, and the like, as well and copolymers, terpolymers, and blends thereof. Preferably the non-elastomeric component of the fibers of the invention includes a polyolefin polymer. Suitable polyolefins include without limitation polymers such as polyethylene (low density polyethylene, high density polyethylene, linear low density polyethylene), polypropylene (isotactic polypropylene, syndiotactic polypropylene, and blends of isotactic polypropylene and atactic polypropylene), poly-1-butene, poly-1-pentene, poly-1-hexene, poly-1-octene, polybutadiene, poly-1,7,-octadiene, and poly-1,4,-hexadiene, and the like, as well as copolymers, terpolymers and mixtures of thereof. Polypropylene is particularly preferred.

Each of the polymeric components can optionally include other components not adversely effecting the desired properties thereof. Exemplary materials which could be used as additional components would include, without limitation, pigments, antioxidants, stabilizers, surfactants, waxes, flow promoters, solid solvents, particulates, and other materials added to enhance processability of the first and the second components. These and other additives can be used in conventional amounts.

The weight ratio of the elastomeric component and the non-elastomeric component can vary. Preferably the weight ratio is in the range of about 10:90 to 90:10, more preferably from about 20:80 to about 80:20, and most preferably from about 35:65 to about 65:35. In addition, the dissociable multicomponent fibers of the invention can be provided as staple fibers, continuous filaments, or meltblown fibers.

In general, staple, multi-filament, and spunbond multicomponent fibers formed in accordance with the present invention can have a fineness of about 0.5 to about 100 denier. Meltblown multicomponent filaments can have a fineness of about 0.001 to about 10.0 denier. Monofilament multicomponent fibers can have a fineness of about 50 to about 10,000 denier. Denier, defined as grams per 9000 meters of fiber, is a frequently used expression of fiber diameter. A lower denier indicates a finer fiber and a hither denier indicates a thicker or heavier fiber, as is known in the art.

Dissociation of the multicomponent fibers provides a plurality of fine denier filaments or microfilaments, each formed of the different polymer components of the multicomponent fiber. As used herein, the terms "fine denier filaments" and "microfilaments" include sub-denier filaments and ultra-fine filaments. Sub-denier filaments typically have deniers in the range of 1 denier per filament or less. Ultra-fine filaments typically have deniers in the range of from about 0.1 to 0.3 denier per filament.

The multicomponent fibers of the present invention are dissociated into separate elastomeric microfilaments (such as polyurethane microfilaments) and non-elastomeric microfilaments (such as polypropylene microfilaments) by thermal treatment under conditions of low or substantially no tension (i.e., under relaxation). As discussed above, the elastomeric and non-elastomeric polymer components are selected so that the polymers have low mutual affinity for one another (or stated differently, have a difference in solubility parameter of at least about 1.2 or greater).

To prepare the fiber bundles of the invention, the multicomponent fibers are extruded (as discussed in more detail below) and drawn. During drawing, the non-elastomeric components are plastically deformed so that the length of the non-elastomeric components increases relative to their undrawn length. When the drawing tension is released, the drawn non-elastomeric components substantially maintain their drawn length. The degree or percent increase in length of the drawn, plastically deformed non-elastomeric components relative to their undrawn length can vary, depending upon a variety of factors such as but not limited to the specific polymers used, the draw ratios, and the like. Generally the plastically deformed, non-elastomeric components exhibit an increase in length relative to their original undrawn length in an amount ranging from about 50 to about 600% increase.

In addition, as the skilled artisan will appreciate, the non-elastomeric component will exhibit a small amount of shrinkage after drawing or stretching when heated under relaxation. However, this is small relative to the elastomeric contraction discussed herein. In general, the non-elastomeric component typically shrinks no more than 20% of its stretched length when heated.

In contrast, the deformation of the elastomeric components is at least partially elastic deformation. That is, the elastomeric components are capable of substantially complete recovery to their original, undrawn length, generally greater than about 75% recovery, and preferably at least about 95% recovery, when stretched in an amount of least about 10% at room temperature. This recovery can be expressed as $$\% \text{ recovery} = (L_s - L_r)/(L_s - L_o) \times 100$$

wherein $L_s$ represents stretched length; $L_r$ represents recovered length measured one minute after recovery; and $L_o$ represents the original length of the material. Thus if not for the adhesion of the plastically deformed, non-elastomeric components to the elastically deformed elastomeric components, the drawn elastomeric components would at least partially return to substantially their original length upon relaxation of the draw forces applied thereto. As a result, if the drawn elastomeric components and the non-elastomeric components were not joined to one another, the individual drawn non-elastomeric components would be longer than the individual drawn elastomeric components.

After drawing, the multicomponent fibers are then thermally treated under conditions of low or substantially no tension (i.e., under relaxation) to release adhesion of the elastomeric and non-elastomeric components. As used herein the term "low tension" means that the tension force is less than the force exerted by the contracting elastomeric material once it is released. The thermal treatment thus initiates separation or splitting of the multicomponent fiber into its respective elastomeric and non-elastomeric components. The thermoplastic elastomer component shrinks and becomes more elastic when exposed to heat in the form of boiling water, hot air, radiant heat or steam. As a result, the elastomeric components contracts or returns to substantially its original undrawn length, due to the elastic recovery properties of the elastomeric components and shrinkage of the elastomeric components. Other sources of energy can be used to activate the thermoplastic elastomer, for example, microwave energy. Thus, the multicomponent fibers of the invention can be split by exposing the drawn fibers to heat sufficient to release the respective components one from another and to allow the elastomeric components to elastically contract and to shrink.

In tests conducted with elastomers such as polyurethane, extruded and drawn polyurethane fibers (monofilaments) experienced shrinkage of at least 25% (relative to the initial elongation length) upon application of heat to the fibers. In certain cases, shrinkages of greater than 50% resulted, depending on parameters such as the particular polymer, the draw ratio and initial elongation, fiber denier and tenacity, and the type of heat applied (e.g., boiling water or microwave energy). Thus, the thermal treatment applied to the multicomponent fibers of the present invention causes splitting of the elastomeric and non-elastomeric components by permitting elastic contraction of the elastomeric component(s) and by causing differential heat shrinkage of the elastomeric and non-elastomeric components.

Figure 2:
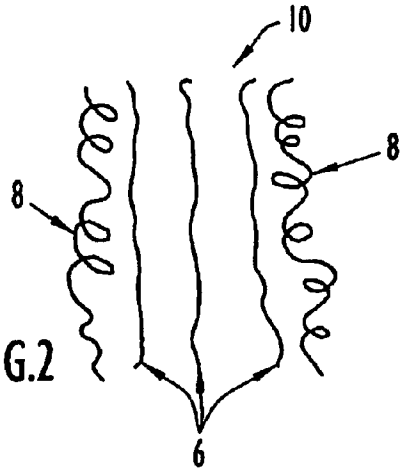
FIG. 2 is a schematic illustration of an exemplary bulked dissociated fiber in accordance with one embodiment of the present invention.

Thermally releasing the adhesive forces between the elastomeric and non-elastomeric components under conditions of low or substantially no tension also causes the non-elastomeric components to bulk. Specifically, the contracting force and shrinkage of the elastomeric component applied to the fiber bundle shortens the length of the bundle. This in turn forces the longer non-elastomeric components into a shorter end-to-end length and thus to bulk, which imparts bulk to the fiber bundle. The resultant fiber bundle includes a plurality of "bulked" non-elastomeric microfilaments substantially surrounding a plurality of elastomeric microfilaments which are less highly bulked, and advantageously which are substantially non-bulked. This is illustrated in FIG. 2, which is a schematic illustration of a cross section of a "puffy" or "bulked" fiber bundle 10 of bulked non-elastomeric microfilaments 8 and less highly bulked elastomeric microfilaments 6.

Thus the non-elastomeric microfilaments are forced by the elastomeric contraction of the elastomeric component to bulk and form a fuzz substantially surrounding the elastomeric microfilaments. The contracting force and shrinkage of the elastomer shortens the length (end-to-end straight line distance) occupied by the bundle. Because the drawn plastically deformed non-elastomeric filaments are longer than the contracted elastomeric filaments, the non-elastomeric components must bunch tip to spin the same end-to-end distance as the contracted elastomeric strands.

Generally, the term bulk refers to an increase in volume of filaments resulting from modification or manipulation of the filaments, and the bulk of the split fiber bundle is greater than the bulk of the unsplit multicomponent fiber. The term bulk as used herein also refers to the formation of a substantially random series of bends, curls, loops, etc. of the non-elastomeric filaments due to the contracting force of the elastomeric components. The specific bulk pattern (specific series of bends, curls, loops) is not permanent or recoverable if the bulked fiber bundle is subsequently stretched and relaxed. That is, although the bulked non-elastomeric filaments will resume a bulked configuration if stretched and relaxed, the new bulked configuration of any individual fiber would not necessarily have the same shape as before. Thus, the bulked non-elastomeric fibers differ from latently crimpable fibers that develop a permanent or recoverable crimp pattern (for example a helical or spiral configuration) when heated, The latently developed crimp is "permanent" or "recoverable" because such crimped fibers return substantially to their original crimped pattern if subsequently stretched and relaxed. Further, the random pattern or configuration of the bulked non-elastomeric components of the invention differs from the substantially regular or symmetrical pattern of spirals of crimped fibers.

As used herein, thermally treating the drawn multicomponent fibers of the invention under conditions of low or substantially no tension involves exposing the fibers to sufficient heat to effectuate the fracturing and separating of the components of the composite fiber. As used herein, the terms "splitting," "dissociating," or "dividing" mean that at least one of the fiber components is separated completely or partially from the original multicomponent fiber. Partial splitting can mean dissociation of some individual segments from the fiber, or dissociation of pairs or groups of segments, which remain together in these pairs or groups, from other individual segments, or pairs or groups of segments from the original fiber along at least a portion of the fiber length. As illustrated in FIG. 2, the fine denier components can remain in proximity to the remaining components as a coherent fiber bundle 10 of fine denier elastomeric microfilaments 6 and non-elastomeric microfilaments 8. However, as the skilled artisan will appreciate, the fibers originating from a common fiber source may be further removed from one another. Further, the terms "splitting," "dissociating," or "dividing" as used herein also include partial splitting.

A multicomponent fiber having 2 to 48, preferably 8 to 20, segments can be produced. Generally, the tenacity of the multicomponent fiber ranges from about 1 to about 9, advantageously from about 2 to about 4 grams/denier (gpd). The tenacity of the elastomeric microfilaments produced in accordance with the present invention can range from about 0.3 to about 2.5 gpd, and typically from about 0.6 to about 1.5, while tenacity for the non-elastomeric fine denier filaments can range from about 1 to about 9, typically from about 2 to about 5 gpd. Grams per denier, a unit well known in the art to characterize fiber tensile strength, refers to the force in grams required to break a given filament or fiber bundle divided by that filament or fiber bundle's denier.

Figure 3:
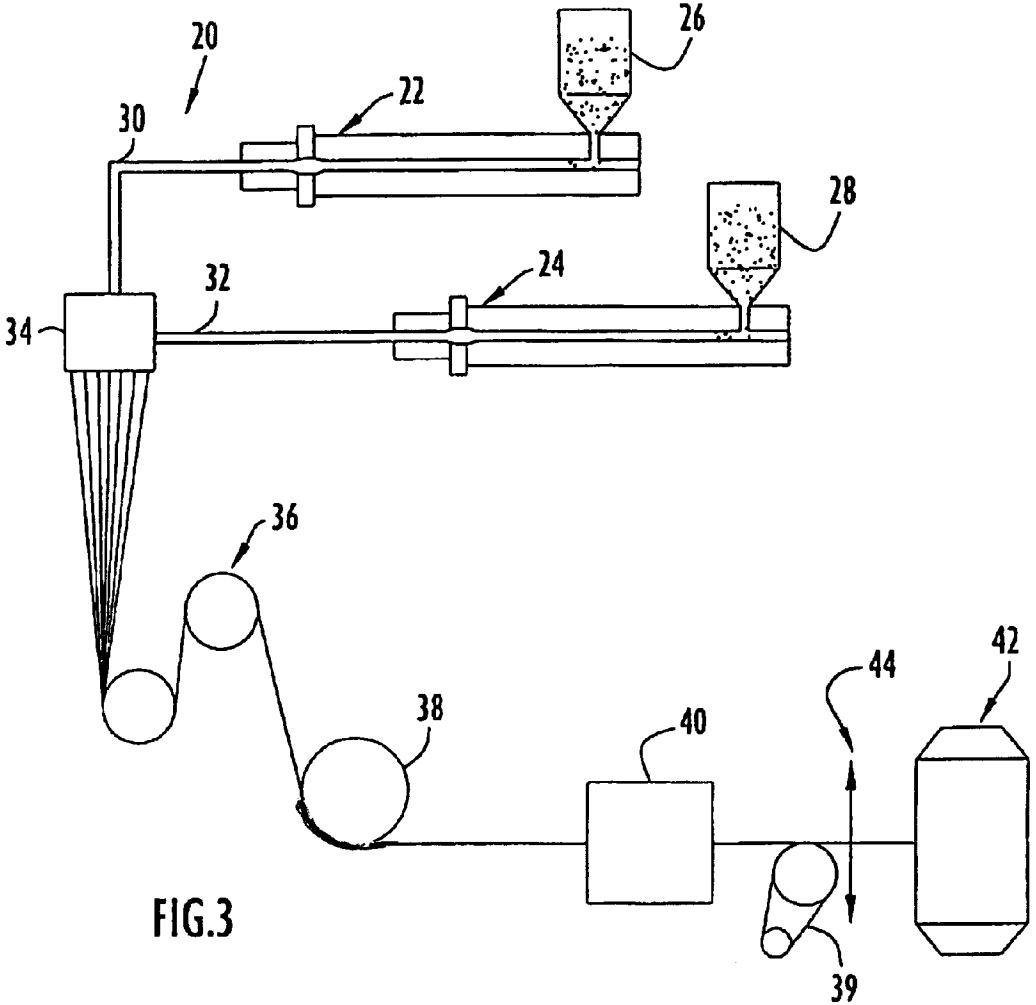
FIG. 3 is a schematic illustration of an exemplary process for making multicomponent fibers of the invention.

The fibers of the invention can be prepared using any of the fiber formation techniques as known in the art including, for example, melt spinning or solution spinning. An exemplary method for producing the fibers of the invention is illustrated in FIG. 3. Turning to FIG. 3, a melt spinning line 20 for producing bicomponent fibers is shown which includes a pair of extruders 22 and 24. As will be appreciated by the skilled artisan, additional extruders may be added to increase the number of components. Extruders 22 and 24 separately extrude elastomeric polymer component 6 and non-elastomeric polymer component 8. Elastomeric polymer 6 is fed into extruder 22 from a hopper 26 and non-elastomeric polymer 8 is fed into extruder 24 from a hopper 28. Polymers 6 and 8 are fed from extruders 22 and 24 through respective conduits 30 and 32 by a melt pump (not shown) to a spinneret 34.

In one advantageous embodiment, a polyurethane polymer stream and a polypropylene stream are employed. The polymers typically are selected to have melting temperatures such that the polymers can be spun at a polymer throughput that enables the spinning of the components through a common capillary at substantially the same temperature without degrading one of the components. For example, polyurethane can be extruded at a temperature ranging from about 160 to about 220° C. Nylon is typically extruded at a temperature ranging from about 250 to about 270° C., and polyethylene and polypropylene are typically extruded at a temperature ranging from about 200 to about 230° C.

Extrusion processes and equipment, including spinnerets, for making multicomponent continuous filament fibers are well known and need not be described here in detail. Generally, spinneret 34 includes a housing containing a spin pack which includes a plurality of plates stacked one on top of the other with a pattern of openings arranged to create flow paths for directing polymer components 6 and 8 separately through the spinneret. The spinneret has openings or holes arranged in one or more rows. The polymers are combined in a spinneret hole. The spinneret is configured so that the extrudant has the desired overall fiber cross section (e.g., round, trilobal, etc.). The spinneret openings form a downwardly extending curtain of filaments. Such a process and apparatus is described, for example, in Hills U.S. Pat. No. 5,162,074, which is incorporated herein by reference in its entirety.

Other apparatus and processes can be employed to extrude and process the multicomponent fibers of the present invention, such as those described in international patent application serial No. PCT/US99/06517, the disclosure of which is incorporated herein by reference in its entirety.

Following extrusion through the die, the resulting thin fluid strands, or filaments, remain in the molten state for some distance before they are solidified by cooling in a surrounding fluid medium, which may be chilled air blown through the strands (not shown). Once solidified, the filaments are taken up on a godet or other take-up surface. For example, in a continuous filament process as illustrated in FIG. 3, the strands are taken up on godet rolls 36 that draw down the thin fluid streams in proportion to the speed of the take-up godet.

Continuous filament fiber may further be processed into staple fiber. In processing staple fibers, large numbers, e.g., 10,000 to 1,000,000 strands, of continuous filament are gathered together following extrusion to form a tow for use in further processing, as is known in that art.

Rather than being taken up on a godet, continuous multicomponent fiber may also be melt spun as a direct laid nonwoven web. In a spunbond process, for example, the strands are collected in an air attenuator following extrusion through the die and then directed onto a take-up surface such as a roller or a moving belt to form a spunbond web. As an alternative, direct laid composite fiber webs may be prepared by a meltblown process, in which air is ejected at the surface of a spinneret to simultaneously draw down and cool the thin fluid polymer streams which are subsequently deposited on a take-up surface in the path of cooling air to form a fiber web.

Regardless of the type of melt spinning procedure which is used, typically the thin fluid streams are melt drawn in a molten state, i.e. before solidification occurs, to orient the polymer molecules for good tenacity. Typical melt draw down ratios known in the art may be utilized. The skilled artisan will appreciate that specific melt draw down is not required for meltblowing processes. When a continuous filament or staple process is employed, it may be desirable to subject the strands to a draw process in which the strands are typically heated past their glass transition point and stretched to several times their original length using conventional drawing equipment, such as, for example, sequential godet rolls operating at differential speeds. Draw ratios can vary, depending upon the specific polymers used, and can be determined using typical ratios known in the art. For example, for a polyurethane/polypropylene multicomponent fiber draw ratios of 1.5 to 7 times are advantageous.

Experimental test results indicate that the post draw capability of a homofilament polyurethane is limited to less than 2-to-1. However, in a bicomponent configuration (e.g., side-by-side 50% 12 MFR polypropylene and 50% polyurethane), draw ratios of 4-to-1 are possible. Thus, bicomponent configurations allow greater drawings without breakage, and the non-elastomer component provides dimensional stability to the drawn fiber allowing good package formation.

Following drawing in the solid state, the continuous filaments can be cut into a desirable fiber length in a staple process as known in the art. The length of the staple fibers generally ranges from about 25 to about 50 millimeters, although the fibers can be longer or shorter as desired. See, for example, U.S. Pat. No. 4.789,592 to Taniguchi et al. and U.S. Pat. No. 5,336,552 to Strack et al., the disclosures of which are incorporated herein by reference in their entireties. Optionally, the fibers may be subjected to a crimping process prior to the formation of staple fibers, as is known in the art. Crimped composite fibers are useful for producing lofty woven and nonwoven fabrics since the microfilaments split from the multicomponent fibers largely retain the crimps of the composite fibers and the crimps increase the bulk or loft of the fabric. Such lofty fine fiber fabric of the present invention exhibits cloth-like textural properties, e.g., softness, drapability and hand, as well as the desirable strength properties of a fabric containing highly oriented fibers.

The multicomponent continuous filaments or staple fibers can be subjected to a thermal treatment step and divided into microfilaments prior to, during, or following fabric formation. For example, returning to FIG. 3, as illustrated, the multicomponent continuous filaments can be thermally treated fibers under conditions of low or substantially no tension by directing the filaments over one or more upstream guide roll(s) 38 to a source of heated air 40 and over one or more downstream guide roll(s) 39, typically running at a slower speed than the upstream rolls, prior to fabric formation. To achieve separation, the fiber is relaxed when it is heated. Although illustrated as a continuous process, the skilled artisan will appreciate that the drawn filaments can be directed to a wind up roll and subsequently directed to a thermal treatment source.

The temperature of the thermal treatment can vary, depending upon the polymer compositions of the fibers, line speed, and the like. Thermal treatment conditions are selected to induce shrinkage and to activate loss of adhesion of the elastomeric and non-elastomeric components to one another and thus to activate dissociation of the elastomeric and non-elastomeric components from one another. However, the thermal treatment temperatures are advantageously maintained to avoid substantial thermal degradation or melting of the components (so that the components substantially maintain their fibrous nature). For example polyurethane/polypropylene fibers can be heated at a temperature at least about 35° C., and preferably a temperature ranging from about 50° C. to about 120° C. In addition, the time required to initiate separation and split the components can range from about 0.1 to about 10 seconds.

In accordance with one embodiment of the present invention, the thermal treatment advantageously comprises exposing or contacting the fibers to a heated gaseous medium, such as heated air. In one advantageous embodiment of the invention, the heated air source 40 can be an air-jet device known in the art for texturizing continuous synthetic filaments. In this embodiment of the invention, the filaments can be simultaneously split and bulked by subjecting the filaments to a hot fluid, such as, for example, a hot jet air stream injected into the into a chamber of the device. Alternatively, the filaments can be sequentially directed through a heated air source and a separate texturizing air jet. Generally, an air jet device involves the use of a nozzle containing the filaments in a jet-nozzle like channel, into which jets of air are directed, cross-wise to or parallel to the direction of filament movement. These air streams create turbulence, causing the formation of loops, resulting in a volume increase of the processed filaments to form a bulky yarn. Thereafter, the filaments can be rolled onto a circular cooling drum (not shown) that functions to cool the filaments emitted from the bulking jet. The filaments are pulled off the cooling drum and deposited onto a bobbin 42 with the aid of a traverse 44.

Other types of heat can be used, including radiant or steam heat. Other types of heating apparatus can also be used, such as hot plates, heated rolls, hot baths (water or oil), and the like. Splitting can be achieved without requiring water. Thus the heated gas can be substantially free of water, although as the skilled artisan will appreciate some amount of water vapor can be present (although generally not appreciably more than what would be present at ambient conditions). This can increase production speeds and lower costs, by eliminating the energy and time costs associated with the energy required to heat water and to dry and remove water from the fiber. Nevertheless, the thermal treatment of the present invention may include exposing the multicomponent fibers to steam or immersion in hot or boiling water.

Microwave energy can also be used to effect thermal treatment of the multicomponent fibers of the present invention As explained in greater detail hereinbelow, the use of microwave energy permits thermal treatment of selected areas of a fiber, yarn or fabric, which may be desirable in certain applications.

Alternatively, the multicomponent filaments or fibers can be formed into a fabric structure, and the multicomponent fibers split during or after fabric formation. For example, staple fiber can be fed into a carding apparatus to form a carded layer. As known in the art, carding generally includes the step of passing staple tow through a carding machine to align the fibers of the staple tow as desired, typically to lay the fibers in roughly parallel rows, although the staple fibers may be oriented differently. The carding machine is generally comprised of a series of revolving cylinders with surfaces covered in teeth. These teeth pass through the staple tow as it is conveyed through the carding machine on a moving surface, such as a drum.

Alternatively, rather than producing a dry laid nonwoven fabric, such as a carded web, the multicomponent filaments or fibers may be formed into other nonwoven web structures as known in the art by direct-laid means. In one embodiment of direct laid fabric, continuous filament is spun directly into nonwoven webs by a spunbonding process. In an alternative embodiment of direct laid fabric, multicomponent fibers of the invention are incorporated into a meltblown fabric. The techniques of spunbonding and meltblowing are known in the art and are discussed in various patents, e.g., Buntin et al., U.S. Pat. No. 3,987,185; Buntin, U.S. Pat. No. 3,972,759; and McAmish et al., U.S. Pat. No. 4,622,259, the disclosures of which are incorporated herein by reference in their entireties. The fiber of the present invention may also be formed into a wet-laid nonwoven fabric, via any suitable technique known in that art.

Regardless of the nonwoven web formation process used, the fibers of the nonwoven web are generally bonded together to form a coherent unitary nonwoven fabric. The bonding step can be any known in the art, such as mechanical bonding, thermal bonding, and chemical bonding. Typical methods of mechanical bonding include hydroentanglement and needle punching. In thermal bonding, heat and/or pressure are applied to the fiber web or nonwoven fabric to increase its strength. Two common methods of thermal bonding are through air heating, used to produce low-density fabrics, and calendering, which produces strong, low-loft fabrics. Hot melt adhesive fibers may optionally be included in the web of the present invention to provide further cohesion to the web at lower thermal bonding temperatures. Such methods are well known in the art.

In one advantageous embodiment of the invention, the nonwoven web is thermally bonded to simultaneously form a coherent nonwoven fabric and to dissociate the multicomponent fiber into microfilaments. Stated differently, thermal forces applied to the multicomponent fibers of the invention during fabric formation in effect split or dissociate the polymer components to form microfilaments.

A variety of thermal bonding techniques are known. For example, the nonwoven web can be directed through the nip of cooperating heated bonding rolls as known in the art. The bonding rolls maybe point bonding rolls, helical bonding rolls, or the like. Bonding conditions, such as temperature and pressure of the rolls, can vary depending upon the polymers used, and are known in the art for different polymers. For example, for polyurethanelpolypropylene multicomponent fibers, the bonding rolls are heated to a temperature from about 120° C. to about 150° C. and are set to a pressure of about 300 to about 1000 pounds of force per inch of fabric width (pounds per linear inch or pli). The web can be fed through the rolls at varying speeds, ranging from about 200 feet per minute to about 300 feet per minute. Other thermal treatment stations can also be used, such as ultrasonic, microwave, or other RF treatment apparatus. Through air bonding equipment can also be used, as well as any of the heat sources noted above. It is noted that the mechanical action of typical processing steps, such as crimping and carding, does not split the fibers.

In one embodiment of the invention, the multicomponent fibers can be split to form self bulked or self texturized microfilament yarn by forming a web of the multicomponent fibers and subjecting the web to mechanical action sufficient to dissociate the fiber components. In this regard, as noted above, the multicomponent fibers of the invention can be mechanically worked in conventional fiber processing steps such as drawing, carding, cutting, and the like, without splitting. However, violent mechanical action, such as hydroentangling or needlepunching, which is sufficient to intimately entangle the fibers to form a coherent web, can also split the multicomponent fibers. Thus in one advantageous embodiment of the invention, the fabric formation process is used to dissociate the multicomponent fiber into microfilaments. The mechanical action is sufficient to release the hold of one polymer component on the other and to allow the elastic contraction of the elastomeric components to force the non-elastomeric components to bulk.

Mechanical fabric formation processes include hydroentanglement and needlepunching. Such processes are known in the art. In hydroentangling, the web is typically conveyed longitudinally to a hydroentangling apparatus wherein a plurality of manifolds, each including one or more rows of fine orifices, direct high pressure water jets through the fiber web to intimately hydroentangle the fibers and form a cohesive fabric. The hydroentangling apparatus can be constructed in a manner known in the art and as described, for example, in U.S. Pat. No. 3,485,706 to Evans, incorporated herein by reference in its entirety. The fiber hydroentanglement is accomplished by jetting liquid, typically water, supplied at a pressure from about 200 psig to about 1800 psig or greater to form fine, essentially columnar, liquid streams. The high pressure streams are directed toward at least one surface of the web. The wen can be supported on a foraminous support screen which can have a pattern to form a nonwoven structure with a pattern or with apertures or the screen can be designed and arranged to form a hydraulically entangled fabric which is not patterned or apertured. The web can pass through the hydraulic entangling apparatus one or more times for hydraulic entanglement on one or both sides of the web or to provide any desired degree of hydroentanglement.

Alternatively, conventional needlepunching apparatus can be used. In this regard, the web can be directed to a conventional needle punching apparatus comprising a set of parallel needle boards positioned above and below the web. Barbed needles are set in a perpendicular manner in the needle boards. During operation, the needle boards move towards and away from each other in a cyclical fashion, forcing the barbed needles to punch into the web and withdraw. This punching action causes the fibers to move on relation to each other and entangle.

Alternatively, as noted above, the nonwoven web can be formed into a unitary coherent nonwoven fabric and thereafter thermally treated to split the fibers. For example, the nonwoven web can be mechanically or adhesively bonded, and the bonded web heated using any of the above techniques to split the fibers.

The resultant fabric thus formed is comprised, for example, of a plurality of microfilaments 6 and 8 shown in FIG. 2, and described previously. In addition, the multicomponent fiber of the present invention may be separated into microfilaments before or after formation into a yarn.

In accordance with another aspect of the present invention, a combination of thermal treatment and subsequent mechanical working can achieve nearly complete splitting of the elastomeric and non-elastomeric segments of the multicomponent fibers which form a synthetic yarn or fabric. A multicomponent fiber comprising two or more incompatible non-elastomeric components can be at least partial split by thermal treatment where the components shrink by different degrees when heated (e.g., a high-shrinkage component and a low-shrinkage component). However, high-shrinkage non-elastomeric polymers typically have limited power to cause separation, and a considerable amount of the high-shrinkage component must be used in the multicomponent fiber to achieve even modest splitting. Further, the resulting yarn, web or fabric is not readily stretchable; thus, it is relatively difficult to achieve further splitting of the fiber components through mechanical working of the yarn or fabric.

In contrast, when elastomeric polymers shrink, they have considerably more power than non-elastomeric polymers to cause separation of the fiber segments; thus, a multicomponent fiber with a certain percentage of an elastomeric component experiences a greater degree of splitting than a multicomponent fiber with a comparable percentage of a high-shrinkage non-elastomeric component. Consequently, unlike splittable non-elastomeric multicomponent fibers which require a substantial quantity of a high-shrinkage component, the multicomponent fibers of the present invention can achieve an acceptable degree of splitting with a relatively small percentage of the fiber being the elastomeric component (e.g., as little as ten percent or less).

Moreover, if complete splitting of the multicomponent fibers of the present invention is not achieved via the thermal treatment, the elasticity of the yarns and fabrics formed from these fibers allows additional splitting to be achieved by simple working of the yarn or fabric. For example, the yarn or fabric can be placed under tension to re-stretch the elastomeric filaments and then released to cause the elastomeric filaments to relax. The stretching and relaxation of the elastomeric filaments causes the elastomeric and non-elastomeric segments to separate at remaining points of attachment An iterative tension-release sequence can be applied to the yarn or fabric using any number of mechanisms (e.g., running the yarn or fabric around two rolls of different size or speed). A small number of iterations results in a nearly complete splitting of the segments of the multicomponent fibers. The more complete splitting achievable with the multicomponent fibers of the present invention advantageously result in a softer, bulkier yarn or fabric with better coverage and filtration properties.

The fibers of the invention can also be used to make other textile structures such as, but not limited, to woven and knit fabrics. Such fabric structures can also be thermally treated as noted above to split the fibers.

In addition, yarns prepared for use in forming such woven and knit fabrics are similarly included within the scope of the present invention. Such yarns may be prepared from continuous filaments or spun yarns comprising staple fibers of the present invention by methods known in the art, such as twisting or air entanglement. As described above, the multicomponent fibers may be heated as described above prior to yarn formation, and the resultant microfilaments directed into a suitable yarn formation apparatus. Alternatively the multicomponent fibers can be directed into a heated texturizing jet to substantially simultaneously split the fiber and form the yarn.

Figure 4D:
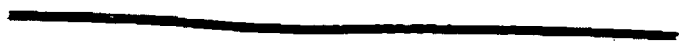
FIGS. 4A–4D are illustrations of a multicomponent fiber at various processing stages in accordance with the present invention.
Figure 4C:
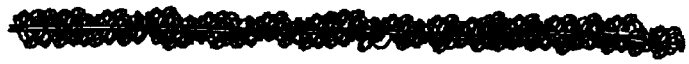
Figure 4B:
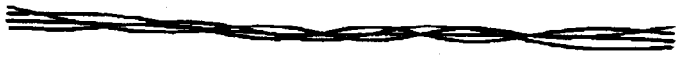
Figure 4A:
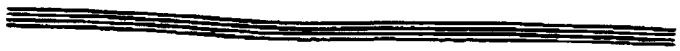

By way of example, a side-by-side bicomponent multifilament yarn can be produced by melt spinning of a thermoplastic elastomer (e.g., polyurethane) and a non-elastomer (e.g., polypropylene) into an unoriented yarn,a partially oriented yarn or a fully oriented yarn. The unoriented and partially oriented yarn are subsequently, in a separated step, drawn, partially drawn or drawtextured (see FIG. 4A). The resulting yarn or the fully oriented yarn is then twisted into a single twisted yarn, as shown in FIG. 4B.

Figure 5B:
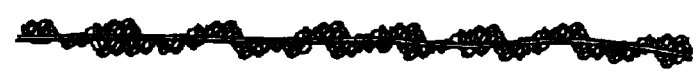
FIG.5B PRIOR ART
FIGS. 5A and 5B are illustrations of conventional air-jet textured yarn and core spun yarn, respectively.
Figure 5A:
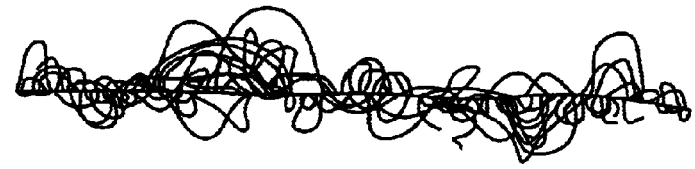
FIG.5A PRIOR ART

The single twisted yarn is subsequently subject to thermal treatment (e.g., hot air, steam, immersion in boiling water or microwave energy). Upon thermal treatment, the elastomer sub-filaments separate from the non-elastomeric sub-filaments of the twisted single yarn, permitting the elastomeric sub-filaments to elastically contract and to shrink significantly (e.g., at least 25 percent of their original drawn length), and force the elastomeric and non-elastomeric sub-filaments to separate from each other. Consequently, the non-elastomeric (e.g., polypropylene) sub-filaments form loops wrapping around the core of the elastomer filaments, as shown in FIG. 4C. The resultant yarn has a structural resemblance to the air-jet textured yarn (FIG. 5A) or the core spun yarn (FIG. 5B). The elastomeric sub-filaments provide good stretching power, as can be seen from the stretched yarn shown in FIG. 4D. The non-elastomeric sub-filaments provide not only a soft spun-like hand, but also abrasive protection to the elastomeric sub-filaments in the core.

Another advantage of the yarn of the present invention is that the size of the polypropylene sub-filaments can be significantly smaller than the filament of an air-jet textured yarn. For example, if each filament of a bicomponent yarn according to the present invention has the cross section shown in FIG. 1F, is 3 dpf, and the weight ratio of the elastomer to the non-elastomer is 50:50, the dpf of each non-elastomer sub-filament is 1.5 dpf. If each filament of a bicomponent yarn has the cross section shown in FIG. 1E, is 3 dpf, and has the same weight ratio of the elastomer to the polypropylene, the dpf of each non-elastomer sub-filament is 0.5 dpf The fabrics of the present invention provide a variety of desirable properties, including elasticity, uniform fiber coverage, and high fiber surface area The fabrics of the present invention also exhibit desirable hand and softness, and can be produced to have different levels of loft. In addition to the foregoing benefits, textile fabric of the present invention may also be economically produced, resulting in garments that have greater comfort and better aesthetics and fit.

Fabrics formed from the multicomponent fibers of the invention are suitable for a wide variety of end uses. In one particularly advantageous embodiment, nonwoven fabric of the instant invention may be used as a synthetic suede. In this embodiment, the microfilaments comprising the nonwoven fabric provide the recovery properties, appealing hand, and tight texture required in synthetic suedes. In addition, nonwoven articles produced in accordance with the invention possess adequate strength and cover.

Nonwoven fabrics made with the splittable filaments of the instant invention should also readily find use as filtration media. In this embodiment, the polymers used to form microfilaments can be selected to provide the tensile properties, insensitivity to moisture, and high surface area considered beneficial in filtration media. In addition, nonwoven articles produced in accordance with the invention possess superior chemical resistance and are advantageously used in corrosive environments. Further, the nonwoven articles produced in accordance with the invention may retain an electrical charge, a requirement for materials used in electret filters. Polyurethane and polypropylene are particularly advantageous for this application because of the chemical resistance of these polymers.

Based on the foregoing characteristics, nonwoven fabrics made with the splittable filaments of the instant invention should readily find use as filtration media in a broad range of applications, including use in bag filters, air filters, mist eliminators, and the like. Bag filters are known for use in filtering paints and coatings, especially hydrocarbon-based paints and primers, chemicals, petrochemical products, and the like. Air filters are useful in filtering large or small volumes of air. Small air volume applications include face mask filters. Large volumes of air are advantageously filtered using electret filters. Electret air filters are particularly useful in applications such as furnace filters, automotive cabin filters, and room air cleaner filters. Mist eliminators, used to remove liquid or solid airborne particles, are employed in a wide range of industrial applications generating waste gas streams.

In addition to their utility as a single layer filtration media, the nonwovens of the present invention may find use in layered septum structures, such as those disclosed in U.S. Pat. No. 5,785,725, the disclosure of which is incorporated herein by reference in its entirety. To increase the porosity of the resulting nonwoven fabric, as well as its insulating capabilities, crimped monocomponent fiber may be included in the fiber web, as described in U.S. Pat. Nos. 4,988,560 and 5,656,368, the disclosures of which are incorporated herein by reference in their entireties. Optionally, it may be advantageous to alter the critical wetting surface tension of the nonwoven fabric, as described in U.S. Pat. No. 5,586,997, the disclosure of which is incorporated herein by reference in its entirety.

Because the multicomponent fibers of the present invention require thermal treatment to "activate" the elastomeric component and cause contraction, shrinkage and splitting, it is possible to activate a fabric or yarn formed from the fibers of the present invention in discrete locations or zones. An optimally tuned and focussed microwave energy source can be used to activate discrete locations while accommodating very high production speeds.

For example, baby diapers are conventionally constructed from several materials that are incorporated into the final product using very complex converting machines. Different components having different properties such as elasticity, porousness and absorbency must be integrated. According to the present invention, different portions of a common fabric formed from the multicomponent fibers of the present invention can be given different properties by selectively activating portions of the fabric with localized thermal treatment, thereby allowing a single material to become multifunctional. In the diaper example, highly elastic waist bands, side panels and leg cuffs can be formed in the nonwoven base sheet of the diaper by selectively heating these areas of the base sheet to locally activate the elastomeric components. Further, pore structure and density gradient zones can be created within a nonwoven absorbent core to optimize performance for specific applications. For example, in a diaper liner or other liner, it may be desirable for certain parts of the liner to wick fluid away from the skin, while other portions of the liner are preferably highly absorbent. According to the present invention, a portion of the liner can be thermally treated, causing the fibers to bulk up, form more void volume and become more absorbent, while other portions of the liner formed of the same material can remain untreated, leaving the material with small pores which help wick fluid away from the skin. Such selective treatment of a fabric can be applied both in the x-y (length-width) direction of the fabric as well as in the z (thickness) direction of the fabric to effectively form a multilayer material from a single layer of the fabric of the present invention.

For aesthetic purposes, disposable absorbent articles (e.g., hand towels, shop towel, the outer surface of diapers, etc.) can be treated in patterns to create a quilted appearance and a soft hand.

The fabrics of the invention may be useful in other applications as well, such as, but not limited to, use in oil or other chemical absorption devices.

The fibers of the present invention can also be used to produce an improved dental floss filament yarn combining a soft low denier filament yarn with an elastic stretch yarn for easy entrance between the teeth and a soft file-like cleaning action when pulled between the teeth. All dental floss yarns made from synthetic fibers are largely aimed toward gentle insertion between the teeth. These yarns should cause minimum discomfort to the gums when pulled between the teeth and over the gums. Such yarns are normally monofilament yarns made from Nylon or ribbon yarns that have a slick surface such as Teflon or Nylon. Many of these yarns are post treated with flavorings, abrasive agents, and dental care products giving them a pleasant taste, cleaning ability and dental care characteristics. Ribbon yarns normally insert with ease between the teeth but have little abrasive action when moved through the teeth. Multifilament yarns insert with ease, have a slightly more abrasive action due to the multifilaments not having a flat surface, and hold the post treatment better. For example, one commercially available dental floss is two plied using a low twist multiple. This slight twist gives the dental floss a slightly better cleaning action due to the filaments not being totally straight.

Multifilament dental floss yarns normally have little elongation, partially due to the need for high strength in a dental floss. The slightly twisted floss is textured which appears to give the product a small amount of resiliency.

A stretchable multi-filament yarn with low twist but having a high wrap of fine filaments on the outer surface would advance the cleaning ability of floss. Such a dental floss yarn can be formed by melt spinning, post twisting and thermally treating the multicomponent fibers of the present invention, such as the side-by-side or tip lobed fibers shown in FIGS. 1A–1I. More specifically, a bicomponent multifilament yarn can be produced by melt spinning a thermoplastic elastomer and a non-elastomer (e.g., polypropylene) into an unoriented yarn, a partially oriented yarn or a fully oriented yarn. The unoriented and partially oriented yarns are subsequently, in a separate step, partially drawn then twisted into a single twisted yarn. The yarn is then subjected to one of the aforementioned forms of thermal treatment to cause the elastomer sub-filaments to separate from the polypropylene sub-filaments, while contracting and shrinking. The polypropylene sub-filaments form loops (wraps) around the core of the elastomer sub-filaments, such that the elastomer sub-filaments provide good stretching power and the polypropylene loops provide a soft bulky wrapped product.

In use, this yarn can be stretched and easily inserted between the teeth. One end of the yarn can then be relaxed while the other end is pulled such that the yarn is drawn through the teeth, providing a cleaning action superior to that of conventional dental floss. Due to the nature of this yarn, flavors and dental care products can be easily applied to the yarn.

The present invention will be further illustrated by the following non-limiting example.

EXAMPLE 1

Continuous multifilament melt spun fiber is produced using a bicomponent extrusion system. A sixteen segment hollow pie/wedge bicomponent fiber is produced having eight segments of polyurethane polymer and eight segments of polypropylene polymer. The weight ratio of polyurethane polymer to polypropylene polymer in the bicomponent fibers is 50:50. The polyurethane is commercially available as Morthane PS440-200, a thermoplastic polyurethane from Morton International, and the polypropylene is commercially available as MRD5-1442 from Union Carbide.

Following extrusion, the filaments are subsequently drawn 3 times, thereby yielding a 3 denier multifilament multicomponent fiber. The filaments are thermally treated by directing the filaments through a chamber into which air heated to a temperature of about 75° C. flows so that the polyurethane and polypropylene segments release and microfilaments of the respective polymers form.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A method for producing microfilaments, comprising:

extruding a plurality of multicomponent fibers having at least one polymer component comprising an elastomeric polymer and at least one polymer component comprising a non-elastomeric polymer, wherein said elastomeric polymer has a solubility parameter ($\delta$) sufficiently different from said non-elastomeric polymer so that said elastomeric component and said non-elastomeric component split upon thermal treatment;

drawing said multicomponent fibers to plastically deform said non-elastomeric component and to attenuate said elastomeric component such that said elastomeric component is capable of elastically contracting upon release of adhesion to the non-elastomeric component; and thermally treating said drawn multicomponent fibers under conditions of low or substantially no tension to separate said multicomponent fibers to form a fiber bundle comprising a plurality of elastomeric microfilaments and a plurality of non-elastomeric microfilaments which are more bulked than said elastomeric microfilaments.

2. The method of claim 1, wherein said thermally treating step comprises thermally treating said fibers at a temperature of at least about 351C.

3. The method of claim 2, wherein said thermally treating step comprises contacting said fibers with a heated gaseous medium.

4. The method of claim 3, wherein said heated gaseous medium comprises heated air substantially free of water.

5. The method of claim 1, wherein said method further comprises texturizing said fibers by directing said fibers through a texturing jet.

6. The method of claim 5, wherein said texturizing step comprises contacting said fibers with a heated jet air stream in said texturizing jet, and wherein said thermally treating step and said texturizing step occur simultaneously.

7. The method of claim 5, wherein said thermally treating step occurs before said texturizing step.

8. The method of claim 1, wherein said elastomeric microfilaments are substantially non-bulked.

9. The method of claim 1, wherein said non-elastomeric microfilaments substantially surround said elastomeric microfilaments and wherein each of said non-elastomeric microfilaments has a random series of substantially non-linear configurations.

10. The method of claim 1, wherein said elastomeric polymer is selected from the group consisting of polyurethane elastomers, ethylene-polybutylene copolymers, poly (ethylene-butylene)polystyrene block copolymers, polyadipate esters, polyester elastomeric polymers, polyamide elastomeric polymers, polyetherester elastomeric polymers, ABA triblock or radial block copolymers, and mixtures thereof.

11. The method of claim 10, wherein said elastomeric polymer is polyurethane.

12. The method of claim 1, wherein said non-elastomeric polymer is selected from the group consisting of polyolefins, polyesters, polyamides, and copolymers and mixtures thereof.

13. The method of claim 12, wherein said non-elastomeric polymer is a polyolefin.

14. The method of claim 13, wherein said polyolefin is polypropylene.

15. The method of claim 1, wherein said thermal treating step comprises applying microwave energy to said multicomponent fibers.

16. The method of claim 1, further comprising:

applying and releasing tension on said drawn multicomponent fibers after the thermally treating step to further separate said multicomponent fibers.

17. The method of claim 16, wherein tension on said drawn multicomponent fibers is applied and released repeatedly.

18. The method of claim 1, further comprising twisting the drawn multicomponent fibers into a yarn.

19. A method for producing microfilaments, comprising:

extruding a plurality of multicomponent fibers comprising at least one elastomeric polyurethane component and at least one non-elastomeric polypropylene component;

drawing said multicomponent fibers to plastically deform said non-elastomeric polypropylene component and to attenuate said elastomeric polyurethane component such that said elastomeric polyurethane is capable of elastically contracting upon release of adhesion to the non-elastomeric component; and contacting said drawn multicomponent fibers with heated air under conditions of low or substantially no tension to separate said multicomponent fibers to form a fiber bundle comprising a plurality of elastomeric polyurethane microfilaments and non-elastomeric polypropylene microfilaments, wherein said polypropylene microfilaments are more bulked than said polyurethane microfilaments, and wherein said polypropylene microfilaments substantially surround said polyurethane microfilaments.

20. A method for producing microfilaments, comprising:

extruding a plurality of multicomponent fibers having at least one polymer component comprising an elastomeric polymer and at least one polymer component comprising a non-elastomeric polymer, wherein said elastomeric polymer has a solubility parameter ($\delta$) sufficiently different from said non-elastomeric polymer so that said elastomeric component and said non-elastomeric component split upon thermal treatment;

drawing said multicomponent fibers to plastically deform said non-elastomeric component and to attenuate said elastomeric component such that said elastomeric component is capable of elastically contracting upon release of adhesion to the non-elastomeric component; and contacting said multicomponent fibers with a heated substantially water free medium under conditions of low or substantially no tension to separate said multicomponent fibers to form a fiber bundle comprising a plurality of elastomeric microfilaments and a plurality of non-elastomeric microfilaments.

* * * * *